US006969135B2

(12) United States Patent
Tamura

(10) Patent No.: US 6,969,135 B2
(45) Date of Patent: Nov. 29, 2005

(54) RECORDING APPARATUS

(75) Inventor: Yasuyuki Tamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 10/155,134

(22) Filed: May 28, 2002

(65) Prior Publication Data

US 2002/0180814 A1 Dec. 5, 2002

(30) Foreign Application Priority Data

May 31, 2001 (JP) ..... 2001-165504

(51) Int. Cl.[7] ..... B41T 29/38
(52) U.S. Cl. ..... 347/5; 347/12; 347/9
(58) Field of Search ..... 347/5, 9–12, 57, 347/58, 180, 128

(56) References Cited

U.S. PATENT DOCUMENTS 4,360,819 A * 11/1982 Saito et al. ..... 347/180
5,477,243 A 12/1995 Tamura ..... 347/12
6,056,385 A 5/2000 Tamura ..... 347/12
6,302,504 B1 * 10/2001 Imanaka et al. ..... 347/9
6,386,674 B1 * 5/2002 Corrigan, III et al. ..... 347/19
6,398,331 B1 * 6/2002 Asaka et al. ..... 347/9

FOREIGN PATENT DOCUMENTS

| | | |
|---|---|---|
| EP | 0 811 488 | 12/1997 |
| JP | 10-44411 | 2/1998 |
| JP | 10-181017 | 7/1998 |

OTHER PUBLICATIONS

U.S. Appl. No. 08/869,924, Y. Tamura, filed Jun. 5, 1997.
U.S. Appl. No. 09/817,040, Y. Tamura, filed Mar. 27, 2001.

* cited by examiner

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

A recording apparatus has a recording head with a data generating unit that converts information transmitted from an external device into recording data that matches the configuration of the recording head for recording by the recording head. The recording apparatus has a first power supply circuit for supplying drive power to a drive element that drives by the nozzles of the recording head and a second power supply circuit that drives the heating elements that control recording by the nozzles. As a result, the recording apparatus can provide stable recording, unaffected by any voltage drop in the circuitry that drives the recording head.

7 Claims, 8 Drawing Sheets

RECORDING APPARATUS

FIELD OF THE INVENTION

The present invention relates to a recording apparatus, and more particularly, to a recording apparatus that records by operating a recording head having a plurality of nozzles.

BACKGROUND OF THE INVENTION

So-called on-demand-type ink jet recording methods have developed rapidly in recent years, among which the so-called bubble jet method, in which ink is heated to boiling by a heater and the force created by the bursting of the bubbles is used to eject ink onto a recording medium, has gained particular favor due to its several advantages, mainly the simplicity of the recording head structure and the density with which a multiplicity of nozzles can be packed onto the recording head. Thus, for example, in a bubble jet recording apparatus, in order to increase the number of nozzles of the recording head it is enough simply to increase the number of nozzles of the recording head.

However, driving a multiplicity of nozzles simultaneously requires instantaneous delivery of large amounts of power, which leads to the occurrence of power voltage drops. Accordingly, steady driving of the nozzles requires an extremely large current.

Moreover, bubble jet recording requires heating the ink to the point of boiling using extremely short pulse power of a few milliseconds in duration, so a large current flows when the nozzles are driven, causing a voltage drop. As a result, when driving a multiplicity of nozzles simultaneously the drive energy for driving the recording head is apt to be inadequate, causing the nozzle drive to become unstable, in other words degrading the recording image.

In order to avoid this problem, the conventional solution is to divide the nozzles of the recording head into a plurality of blocks, turn the blocks into drive control units and drive the blocks separately.

However, if the total number of nozzles is very large then the number of nozzles included in one block increases, with the result that the same voltage drop problem arises as when the nozzles are driven individually.

By the same token, reducing the number of nozzles included within a block and increasing the number of blocks in order to reduce the number of nozzles driven simultaneously within the same block results in an increase in the time required to drive the blocks by an amount equivalent to the number of additional blocks, thus necessarily reducing the drive frequency.

One common and widely known method for solving the voltage drop problem is called "remote sensing". The remote sensing method involves detecting the voltage at the circuit portion of the end that consumes power and feeding the detected voltage back to the power source constant voltage circuit so as to maintain the voltage at the power-consuming end portion.

However, the remote sensing method requires a high-speed feedback circuit in order to feed back such an extremely short pulse current. Moreover, where the wiring is long a phase lag arises, making it impossible to operate the high-speed feedback circuit with stability, causing the circuit operation to become unstable and creating oscillation.

A previous application by the applicant, Japanese Laid-Open Patent Application No. 10-181017, discloses a method of counting the number of nozzles to be driven simultaneously and determining the length of the drive voltage pulse according to the count. This method involves predicting the voltage drop to be incurred based on the number of nozzles to be driven simultaneously and correcting the drive pulse length by an amount equivalent to the predicted voltage drop so as to deliver a predetermined amount of power, making it possible to drive the recording head with stability and without excess voltage.

However, the method described above also suffers from a disadvantage, in that unevenness in the wiring resistances of the drive circuit of the recording head and of the heat-emitting element make it difficult to perfectly correct the drive pulse length.

Moreover, in the event that a large capacity condenser is provided on the power supply wiring, the voltage drop cannot be completely corrected because the voltage drop is affected not only by the instantaneous current consumption but also by the immediately preceding power consumption.

Thus, as described above, a variety of factors contributed to fluctuations in the power supply voltage, and ordinarily even with a voltage drop, in order to ensure sufficient power required to drive the nozzles, the pulse length must of necessity be set rather larger than would ordinarily be the case. As a result, an excessive load is applied to the heat-emitting element and the heat-emitting element is therefore heated excessively, thus shortening the working life of the heat-emitting element and degrading the quality of the recorded image as overheating reduces the ejection capacity of the nozzles.

SUMMARY OF THE INVENTION

Accordingly, the present invention has been proposed to solve the above-described problems of the conventional art, and has as its object to provide a recording apparatus capable of providing superior image recording free from the influence of voltage drops and the like.

According to one aspect of present invention, the above-described objects are achieved by a recording apparatus that uses information transmitted from an external device to scan a carriage mounting a recording head across a recording medium, the recording apparatus comprising:

recording data generating means for converting information transmitted from an external device into recording data appropriate to a configuration of the recording head;

a drive element for driving heat-emitting elements of the recording head selectively, in order to record based on the recording data converted by the recording data generating means;

a first power supply means for supplying drive power to the drive element; and a second power supply means for supplying drive power to the heat-emitting elements.

According to another aspect of present invention, the above-described objects are achieved by the recording apparatus as described above, wherein the first and second power supply means are independent power supply sources.

According to another aspect of present invention, the above-described objects are achieved by the recording apparatus as described above, wherein:

the drive element is either an emitter follower-type drive transistor or a source follower-type drive transistor; and the first power supply means supplies power to drive either the base or the gate of the drive transistor.

According to another aspect of present invention, the above-described objects are achieved by the recording apparatus as described above, wherein:

the drive element is a p-channel MOS transistor; and the power that drives the drive element and the power supplied to the heating element are both negative power sources.

Other objects, features and advantages of the present invention will become more apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

It should be noted that, in the following embodiments, the description assumes a printer that is a recording apparatus employing an ink jet recording method.

It should further be noted that, in the present specification, the term "recording" (hereinafter sometimes used interchangeably with the term "print") is used not only in the case of print, graphics and other meaningful information. Rather, the term is used in its broadest sense to include also images, patterns and the like on a recording medium, whether meaningful or not, whether directly readable by the human eye or not, and also specifically includes the processing of such medium as well.

Additionally, the term "recording medium" herein means not only the paper used in any typical recording apparatus but any material capable of retaining ink, including (but not limited to) cloth and other fabrics, plastic and film, metallic plates, glass, ceramics, wood, leather, and so forth.

Moreover, the term "ink" (hereinafter sometimes used interchangeably with the term "fluid"), like the term "recording" (or "print"), is also meant to be interpreted in the broadest sense to mean a fluid that forms an image, pattern or the like when applied to the surface of the recording medium as well as the fluid supplied in the processing of the recording medium or the processing of the ink.

Figure 1:
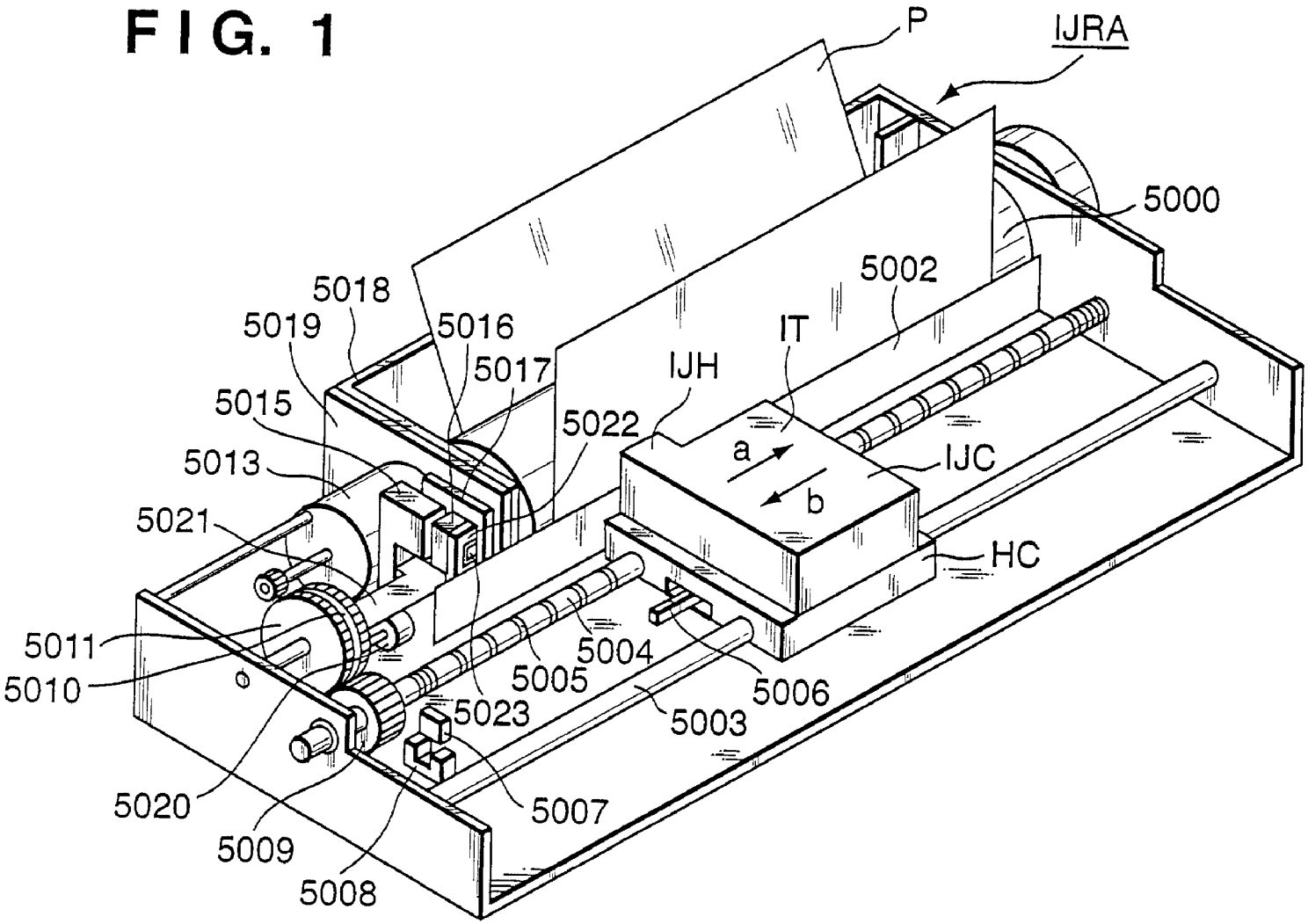
FIG. 1 is a perspective external view of a recording apparatus that is one embodiment of the present invention.

FIG. 1 is a perspective external view of a recording apparatus that is one embodiment of the present invention, in this case an ink jet printer IJRA.

As shown in FIG. 1, a head carriage (HC) engages a spiral groove 5005 of a lead screw 5004 that is rotated via a drive force transmission gear assembly 5009–5011 linked to the forward mid reverse rotation of a drive motor 5013. The head carriage HC has a pin (not shown in the diagram), and moves back and forth in directions indicated by arrows a and b while supported by a guide rail 5003. The head carriage HC mounts an ink jet cartridge (IJC) that forms a single integrated unit with a recording head (IJH) and ink tank (IT).

Reference numeral 5002 denotes a paper retention plate, and presses the recording paper against a platen as the carriage HC moves in the a-b direction. Reference numerals 5007 and 5008 denote photo couplers, which check the area for the presence of a carriage lever 5006 and thus act as a position detector. The photo couplers 5007, 5008, upon sensing that presence of the lever 5006, reverse the direction of rotation of the motor 5013.

Reference numeral 5016 is a member that supports a cap member 5022 that caps a front surface of the recording head ITH. Reference numeral 5015 is a suction unit that exerts suction on an inner surface of the cap, suctioning ink from the recording head via an opening 5023 in the cap. Reference numeral 5017 is a cleaning blade and 5019 is a member that allows the cleaning blade 5017 to move back and forth, supported by a main support plate 5018. Those of ordinary skill in the art can appreciate that the cleaning blade 5017 may be any cleaning blade commonly used and widely known, and adapted to the present embodiment.

Additionally, reference numeral 5021 denotes a lever that commences suction in the suction unit 5015, and that moves with a cam 5020 that engages the carriage and is controlled by a commonly known drive mechanism such as a clutch switch and the like for controlling the drive force from the drive motor.

This capping, cleaning and suctional return are enabled by a construction in which the desired operation can be carried out at positions which correspond to these processes as appropriate, by the operation of the lead screw 5004 when the carriage has come to the home position. Provided these processes are carried out in any well-known sequence, any or all of these may be adapted to the present embodiment.

Next, a description will be given of a control configuration for executing recording control of the apparatus described above.

Figure 2:
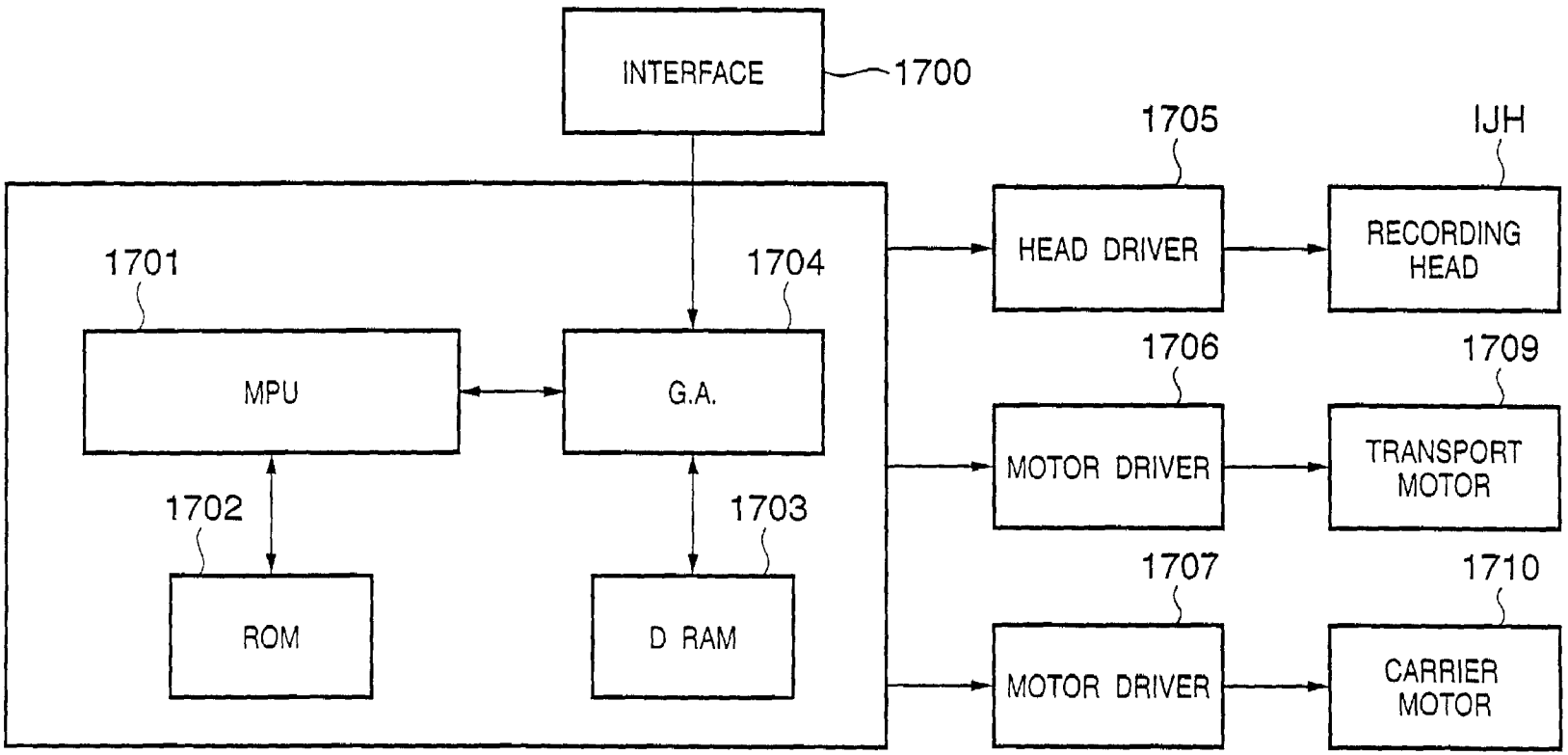
FIG. 2 is a block diagram of a printer control mechanism.

FIG. 2 is a block diagram of a control circuit for an ink jet recording apparatus.

As shown in the diagram, reference numeral 1700 denotes an interface that inputs a recording signal, 1701 denotes an MPU, 1702 denotes a ROM containing a program that the MPU 1701 executes and 1703 is a DRAM that stores a wide variety of data, including the above-described recording signals and recording data supplied to the head. Reference numeral 1704 denotes a gate array that controls the supply of recording data to the recording head IJH, and controls the transfer of data among the interface 1700, the MPU 1701 and the RAM 1703. Reference numeral 1710 is a carrier motor for transporting the recording head IJH. Reference numeral 1709 is a transport motor for transporting the recording paper. Reference numeral 1705 is a head driver for driving the recording head, and 1706 and 1707 are motor drivers for driving the transport motor 1709 and the carrier motor 1710, respectively.

When a recording signal is entered into the interface 1700, the recording signal is converted to print recording data between the gate array 1704 and the MPU 1701. Then, when the motor drivers 1706, 1707 are driven, the recording head is driven in accordance with the recording data sent from the head driver 1705 and recording performed.

It should be noted that, although in the above-described embodiment the control program executed by the MPU 1701 is stored in the ROM 1702, it is also possible to further add an erasable/writable recording medium such as an EEPROM and the like and to alter the control program from a host computer connected to the ink jet printer IJRA.

Those of ordinary skill in the art can appreciate that, as described above, the ink tank IT and the recording head IJH may be formed into a single unit as an interchangeable ink jet cartridge IJC. Of course, the ink tank IT and the recording head IJH may be detachable from each other, so that the ink tank IT can be replaced when the ink is depleted.

Figure 3:
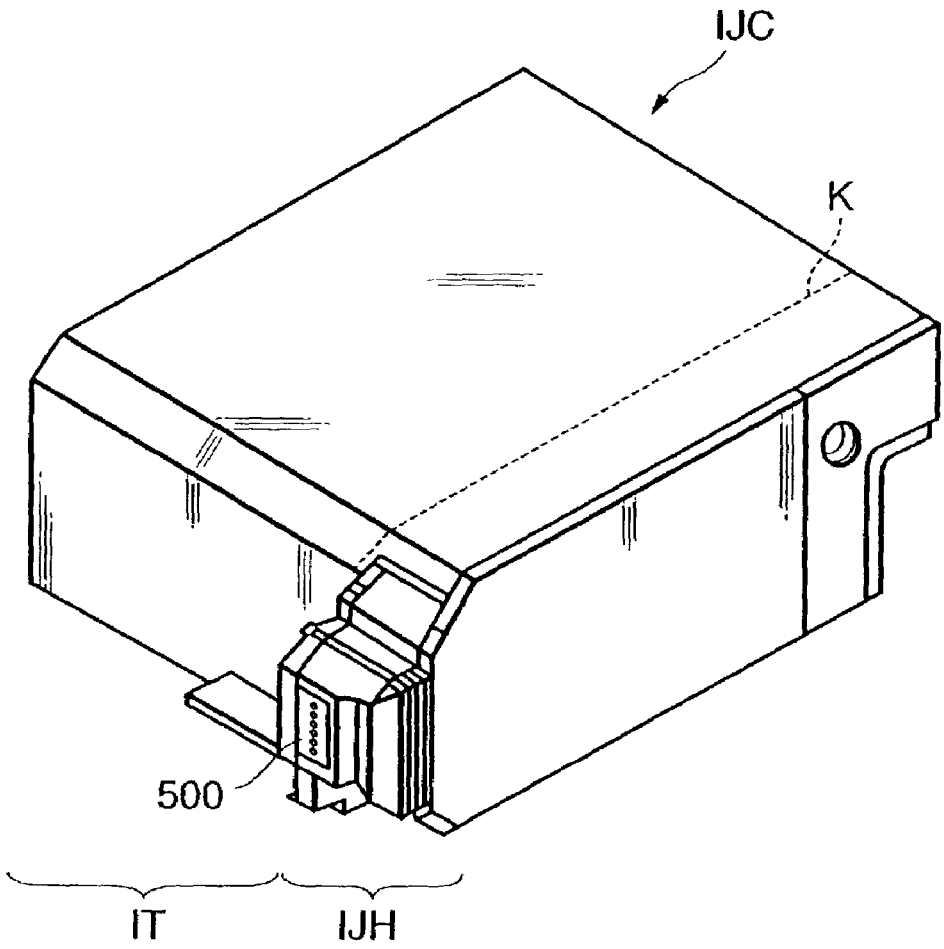
FIG. 3 is a diagram of an ink jet cartridge for the printer of FIG. 1.

FIG. 3 is an external perspective diagram of an ink jet cartridge IJC for the printer of FIG. 1, in which the ink tank can be detached from the head.

As shown in FIG. 3, the ink jet cartridge IJC is constructed so that the ink tank IT and the recording head IJH are separable along the borderline K. The ink jet cartridge IJC is equipped with an electrode (not shown in the diagram) that receives electrical signals supplied from the head carriage HC when the ink jet cartridge IJC is loaded into the carriage. As described above, the electrical signals so supplied drive the ink jet recording head IJH, expelling the ink.

It should be noted that, in FIG. 3, reference numeral 500 denotes a row of ink jet ejection ports. Additionally, the ink tank IT is provided with an ink absorber made of fibrous or porous material to hold the ink.

A description will now be given of a first embodiment of the present invention, with reference to the accompanying drawings.

Figure 4:
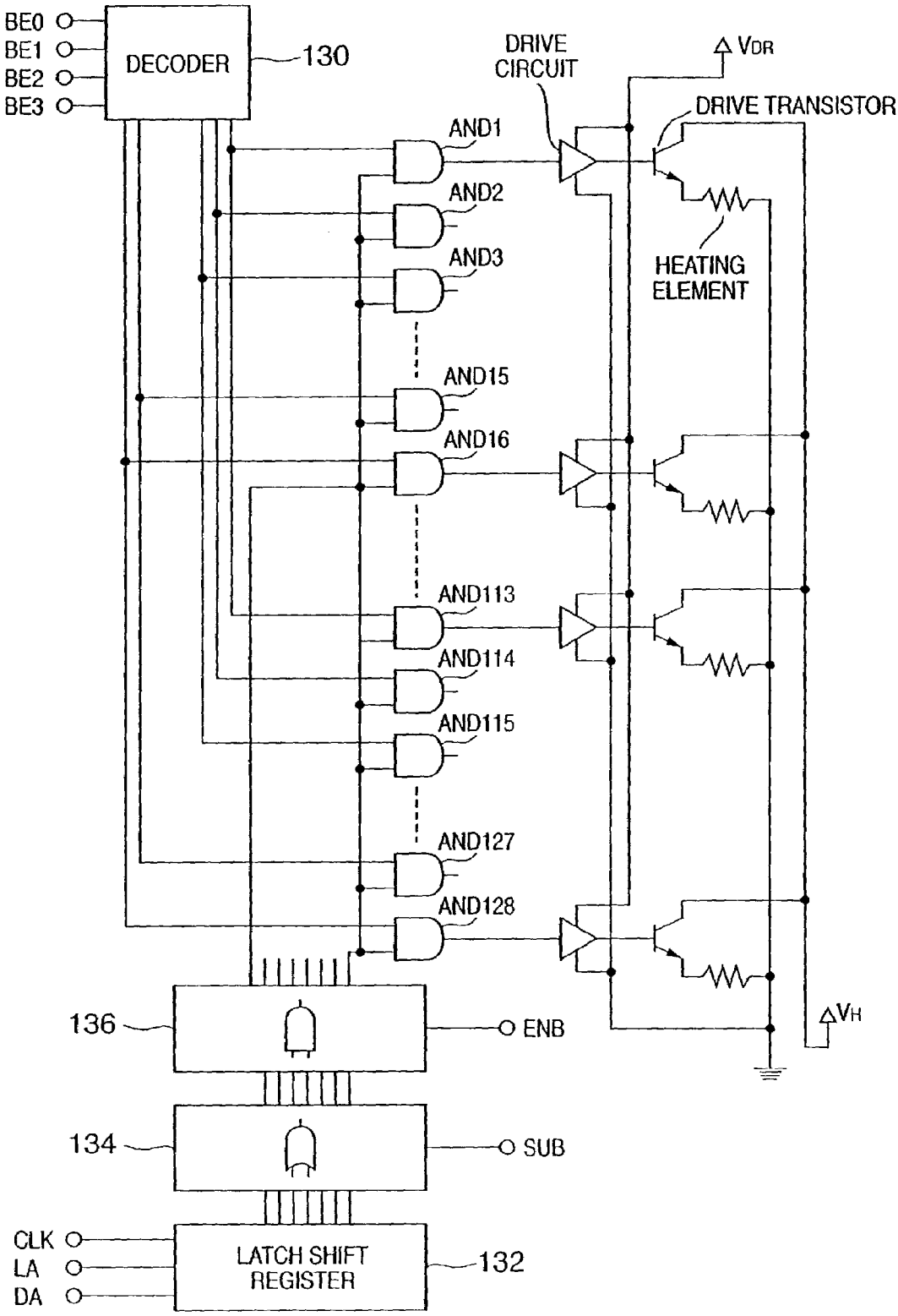
FIG. 4 is a circuit diagram for illustrating the circuit configuration of the recording apparatus of FIG. 1.

FIG. 4 is a circuit diagram for illustrating the circuit configuration of the recording apparatus of FIG. 1.

The circuit diagram of FIG. 4 represents the drive circuit of the present invention adapted to a drive circuit for a heat-emitting element disclosed in the applicant's previous application, Japanese Laid-Open Patent Application No. 10-44411. Those of ordinary skill in the art can appreciate that the applications of the present invention are not limited to such an adaptation, and it goes without saying that the present invention can be adapted to any other ink jet recording head having an equivalent logic circuit. In the diagram, the heat-emitting element (resistor) drive voltage is supplied from the supply voltage $V_H$.

A detailed description will now be given of the drive voltage and the heat-emitting element, with reference to FIG. 5.

Figure 5:
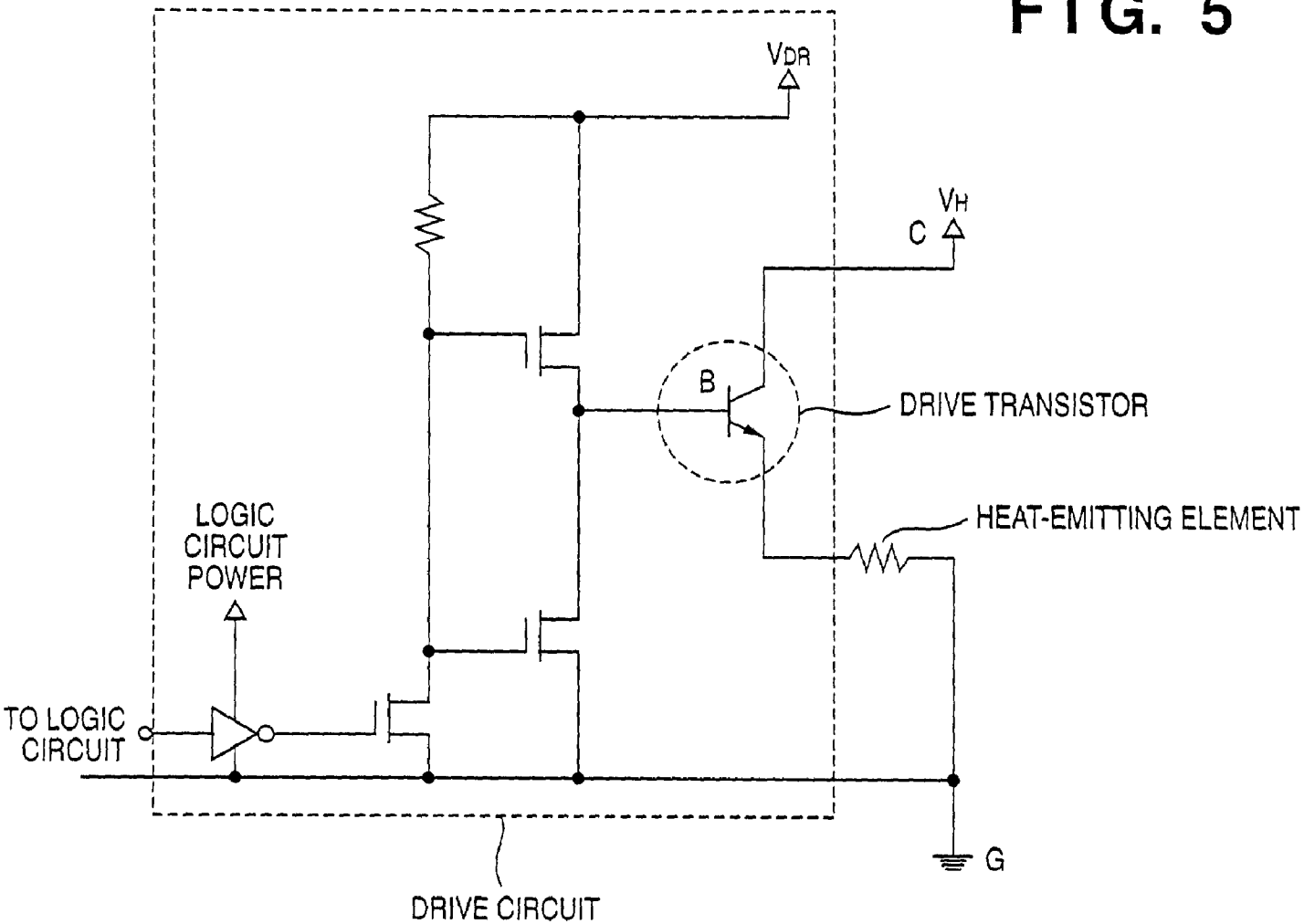
FIG. 5 is a diagram showing a detailed view of a drive circuit and a drive transistor of the circuit shown in FIG. 4.

FIG. 5 is a diagram showing a detailed view of a drive circuit and a drive transistor of the circuit shown in FIG. 4.

As shown in the diagram, $V_H$ is a supply voltage that supplies a drive voltage to the heat-emitting element, and is typically set at approximately 10–40 volts. $V_{DR}$ denotes a supply voltage that drives the drive circuit, and is approximately the same as the heat-emitting element power. The circuit is configured so that the power lines for the heat-emitting element and the drive circuit are separate.

In the circuit described above, when the drive transistor is switched to the ON state (that is, the base voltage is HIGH), the base (B) current and the collector (C) current are both applied to the heat-emitting element. In other words, the voltage applied to the heat-emitting element is determined by the voltage that turns the drive transistor base (B) ON/OFF, so although the effect of the voltage ($V_H$) supplied from the collector side is eliminated the circuit still does not avoid the effect of the voltage drop over the wiring on the ground (G) side. In other words, when the heat-emitting element is driven and a large current flows, the electric potential at the ground rises and, as a result, the voltage applied between the terminals of the heat-emitting element drops. By contrast, by sufficiently reducing the impedance in the ground wiring it is possible to prevent a voltage drop.

Conventionally, it has been necessary to reduce the impedance in the wiring at both sides of the heat-emitting element, but by the application of the present invention it is sufficient to reduce the impedance at one end only (the ground side), thus simplifying its design.

Figure 6:
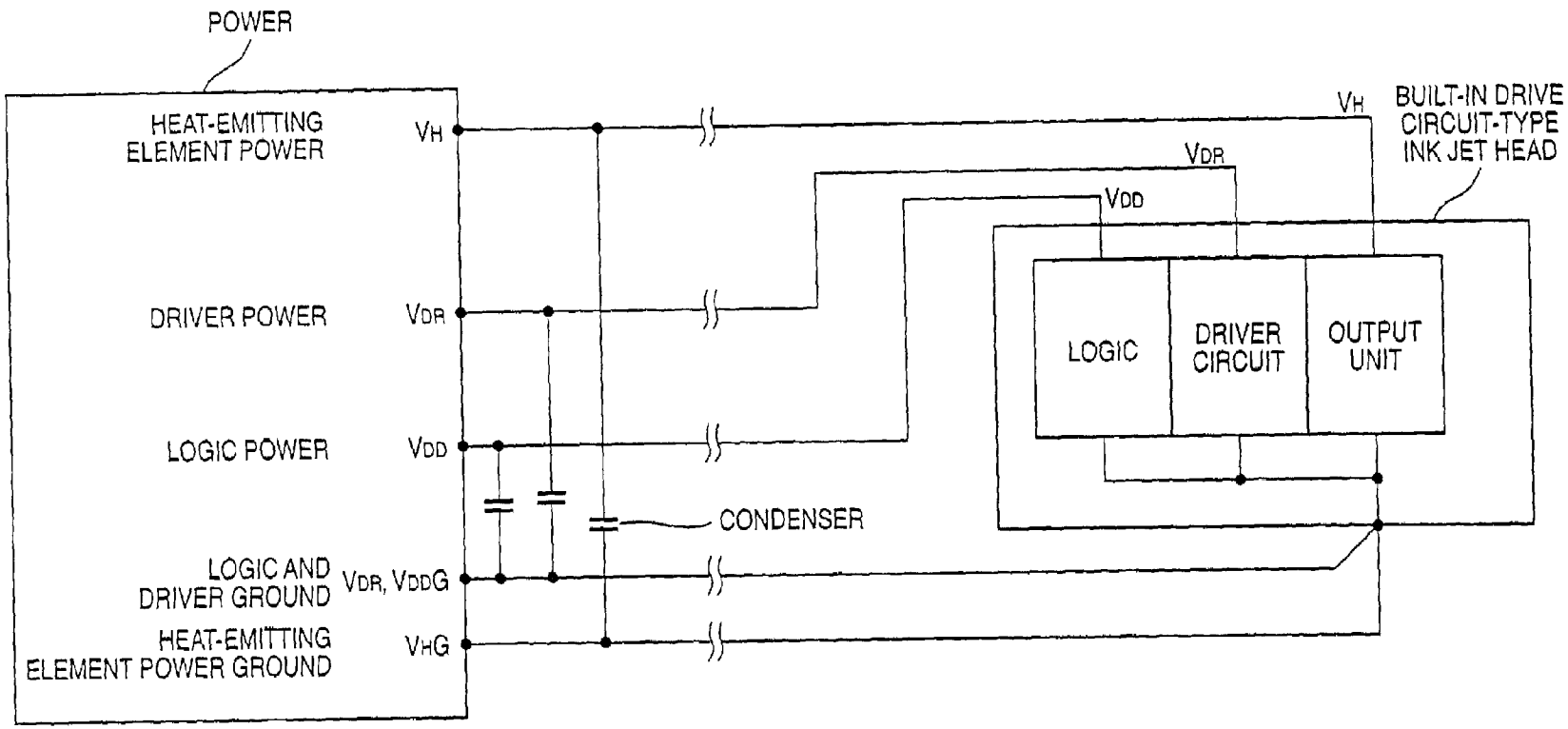
FIG. 6 is a diagram illustrating a modification of one embodiment of the present invention that eliminates the effects of a voltage drop across the ground wiring.

Additionally, the effect of the voltage drop over the ground (G) wiring can be eliminated by modifying the embodiment. FIG. 6 shows one such embodiment.

FIG. 6 is a diagram illustrating a modification of one embodiment of the present invention that eliminates the effects of a voltage drop across the ground wiring.

Although in the embodiment shown in FIG. 6, on the power supply side, the heat-emitting element power ground $V_H$G and logic as well as the drive ground $V_{DR}$, $V_{DD}$G are each provided separately, both the drive circuit ground and the heat-emitting element drive power ground are jointly connected on the ink jet head side. The drive circuit power consumption is small, making it possible to ignore the ground wiring voltage drop, the power is sufficiently stable, and providing an adequate electrostatic condenser on the power outlet terminal smoothes the drive circuit high side voltage and is constant with respect to the ground electric potential at the head unit. Accordingly, the base electric potential of the drive transistor of the drive circuit is virtually constant with respect to the earth ground voltage, and the voltage across the terminals of the heat-emitting element is virtually constant.

It should be noted that providing a bypass condenser at a location near the ink jet head of the power source of the drive circuit and the logic circuit is also effective.

Figure 7:
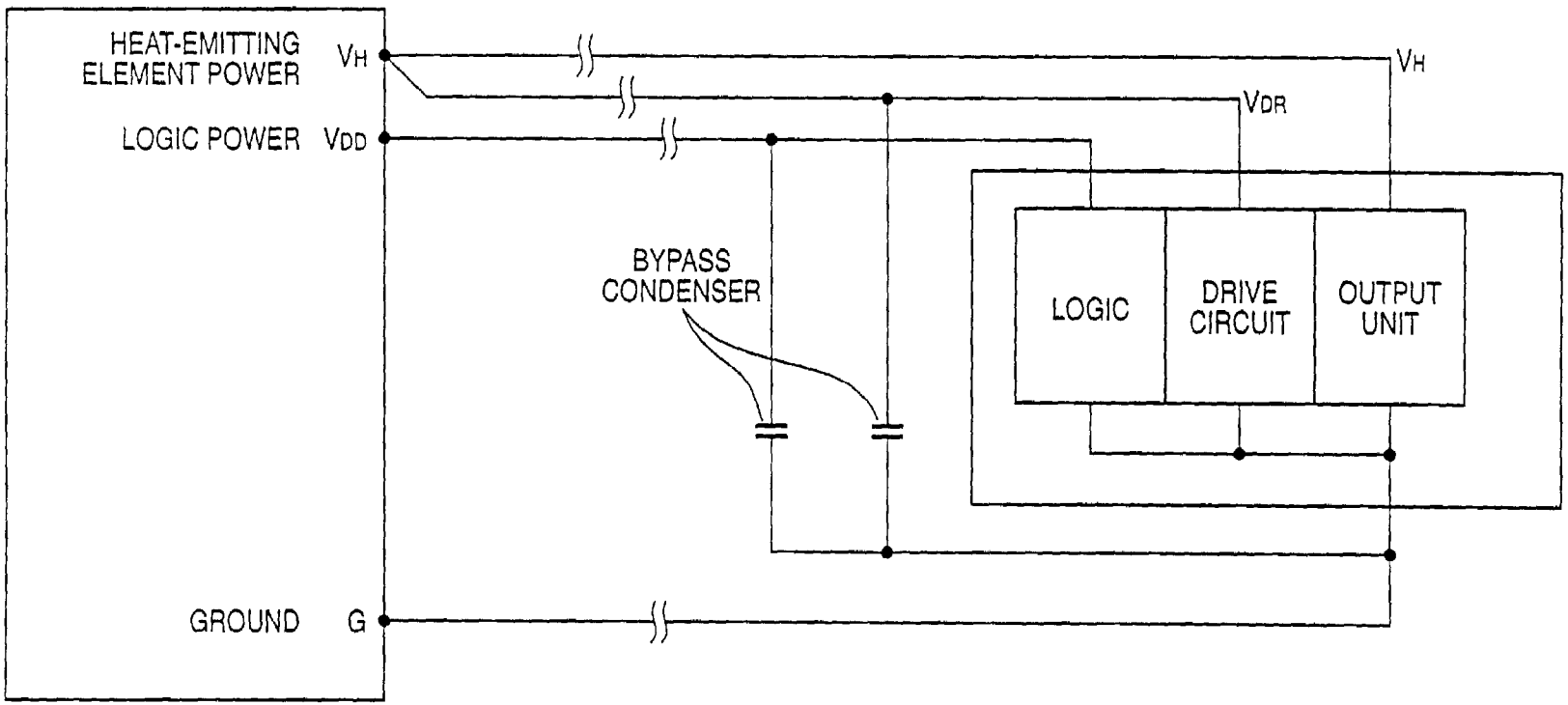
FIG. 7 is a diagram illustrating a configuration in which power lines to the heat-emitting element and the drive circuit are separated at the circuit but joined at a remote location.

FIG. 7 is a diagram illustrating a configuration in which power lines to the heat-emitting element and the drive circuit are separated at the circuit but joined at a remote location.

As shown in FIG. 7, when a bypass condenser of sufficient electrostatic capacity is provided at a location near the ink jet head of the power source of the drive circuit and the logic circuit, and the wiring for the output unit (heat-emitting element) and for the drive circuit are separated as the heat-emitting element drive voltage ($V_H$) and the drive circuit drive voltage ($V_{DR}$), a remote power supply source may be common and still function effectively.

By using an emitter follower-type circuit or a source follower-type circuit, the voltage applied to the heat-emitting element is controlled by the voltage applied to the base or gate of the transistor virtually unaffected by the voltage over the power lines applied to the collector or drain of the transistor. Accordingly, by making the power for the drive circuit that drives the base or gate separate from the power line that supplies power to the heat-emitting element, the voltage applied to the heat-emitting element by the supply of power from the base remains virtually unchanged and can thus be stabilized even when the electric current flowing to the heat-emitting element increases sharply and a voltage drop over the power line occurs. Accordingly, the heat-emitting element can be driven at a constant power, without a sharp decrease in current.

Additionally, excess voltage when the voltage drop is small is absorbed by the drive transistor, without being applied to the heat-emitting element. As a result, the drive transistor, though larger than the conventional ink jet recording head, overall consumes less power. The reduction in power consumption arises because the current is practically proportional to the voltage in the conventional ink jet recording head circuit, and so power consumption is practically proportional to the square of the voltage. By contrast, in the application of the present embodiment according to the present invention, the power consumption is no more than proportional to the voltage. As a result, excess heating of the recording head where the recording density is low (such low-density areas accounting for the majority of the typical recording image)can be prevented and the speed of the recording can be increased.

A description will now be given of a second embodiment of the present invention, with reference to the accompanying drawings.

Figure 8:
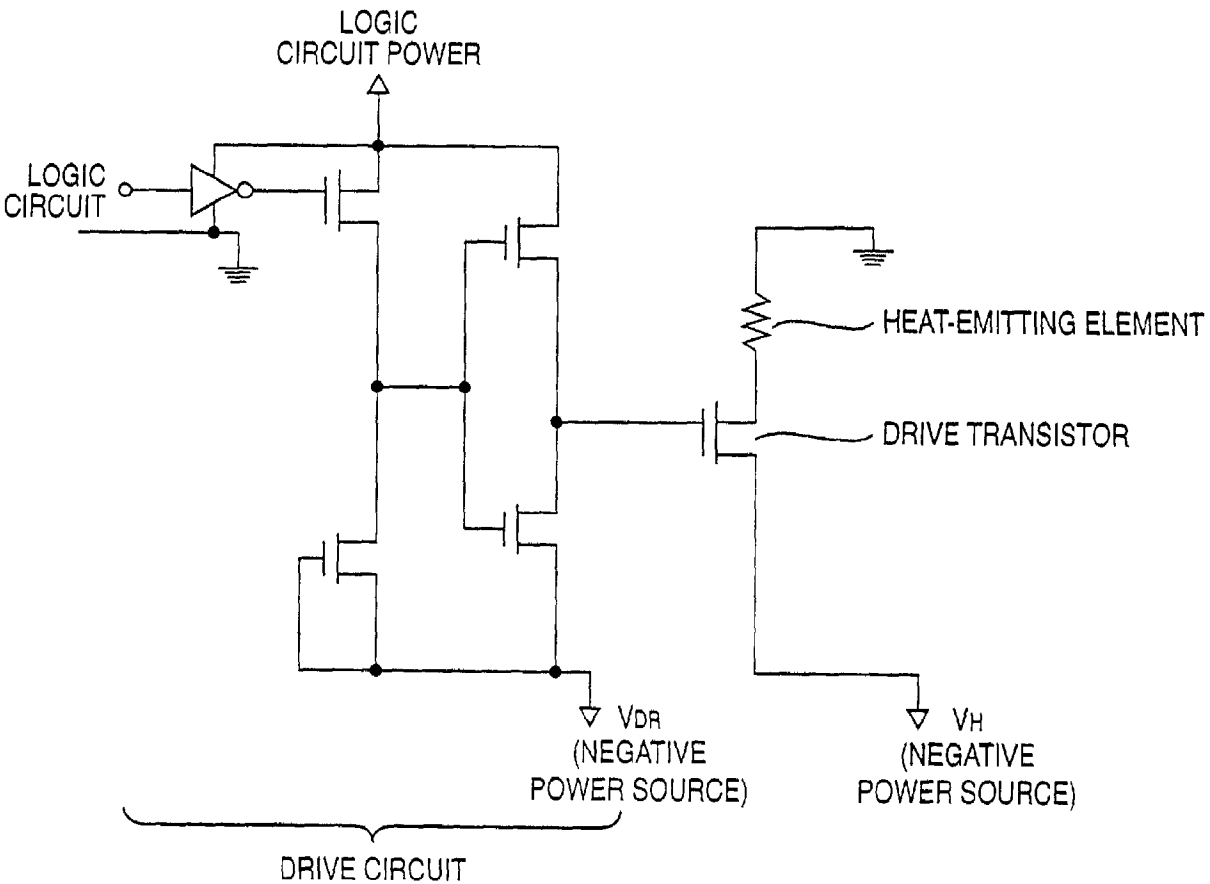
FIG. 8 is a diagram of a drive circuit and drive transistor of a second embodiment of the present invention.

FIG. 8 is a diagram of a drive circuit and drive transistor of a second embodiment of the present invention.

As shown in FIG. 8, the drive element is a p-channel MOS transistor, and power supplied to the heat-emitting element $V_H$ and the drive circuit drive power $V_{DR}$ are both negative power sources. Additionally, the positive side of the power for the drive circuit and the positive side of the power for the logic circuit are the same. In such a circuit as well, the voltage applied to the negative side of the heat-emitting element is the source voltage of the drive transistor and is controlled by the gate voltage, so the effects of fluctuations in the $V_H$ side voltage are virtually eliminated.

Accordingly, by providing a drive circuit power source that is independent of the power line that supplies power to the heat-emitting element, the voltage that is applied to the heat-emitting element remains virtually unchanged and can thus be stabilized even when the electric current flowing to the heat-emitting element increases sharply and a voltage drop over the power line occurs. Accordingly, the heat-emitting element can be driven at a constant power, without a sharp decrease in current.

Those of ordinary skill in the art can appreciate that although the embodiments described above assume that the fluid ejected from the recording head is ink, and that the fluid contained in the ink tank is ink, the present invention is not limited to a case in which the fluid is ink. Thus, for example, a processing fluid ejected onto the recording medium in order to enhance the adhesive or waterproof qualities of the recording image or to improve the quality of the image may be contained in the ink tank.

Those of ordinary skill in the art can appreciate that the present invention can be adapted to a system composed of a plurality of devices. These devices may include a host computer, an interface device, a reader, a printer, and so forth. Or alternatively, the present invention may be adapted to an apparatus composed of a single device.

As described above, the present invention makes it possible to supply a constant voltage to the heat-emitting element without regard to the number of heat-emitting elements to be driven simultaneously, and without being affected by any voltage drop across the power lines.

Additionally, the present invention makes it possible to prevent excess voltage supply and to drive the heat-emitting element with the minimum required voltage and pulse length. As a result, the heat-emitting element suffers no burns, and a stable, superior recording image can be obtained.

Additionally, the heat-emitting element does not get overheated and deterioration due to that cause can be prevented, thereby making it possible to improve and extend the working life of the heat-emitting element.

As many apparently widely different embodiments of the present invention can be made without departing from the spirit and scope thereof, it is to be understood that the invention is not limited to the specific preferred embodiments described above thereof except as defined in the claims.

What is claimed is:

1. A recording apparatus that uses information transmitted from an external device to scan a carriage mounting a recording head across a recording medium, the recording apparatus comprising:

recording data generating means for converting information transmitted from an external device into recording data in accordance with a configuration of the recording head;

a drive element for driving heat-emitting elements of the recording head selectively, based on the recording data converted by said recording data generating means;

a first electric power supply circuit, having a first ground wiring, for supplying electric power to said drive element; and a second electric power supply circuit, having a second ground wiring different from the first ground wiring, for supplying electric power to the heat-emitting elements, wherein said drive element includes one of an emitter follower-type drive transistor and a source follower-type drive transistor, and wherein said first electric power supply circuit supplies the electric power to drive one of a base and a gate of said drive transistor.

2. The recording apparatus according to claim 1, wherein said first electric power supply circuit and said second electric power supply circuit are each independent power sources.

3. The recording apparatus according to claim 1, wherein:

said drive element is a p-channel MOS transistor, and the power that drives said drive element and the power supplied to the heat-emitting elements are both negative power sources.

4. The recording apparatus according to claim 1, wherein the recording head is an ink jet recording head that records by ejecting ink.

5. The recording apparatus according to claim 1, wherein the recording head uses heat to eject the ink and each heat-emitting element comprises a thermal energy converter for generating thermal energy to be applied to the ink.

6. The recording apparatus according to claim 1, wherein an impedance of a ground side wiring electrically connected to each heat-emitting element is smaller than an impedance of wiring of another side electrically connected to each heat-emitting element.

7. The recording apparatus according to claim 1, further comprising a bypass condenser which is independent from said second electric power supply circuit and is disposed between said first electric power supply circuit and a ground side wiring.

* * * * *